US008059994B2

(12) United States Patent
Masui

(10) Patent No.: US 8,059,994 B2
(45) Date of Patent: Nov. 15, 2011

(54) IMAGE FORMING UNIT AND IMAGE FORMING APPARATUS

(75) Inventor: Naoki Masui, Tokyo (JP)

(73) Assignee: Oki Data Corporation, Tokyo (JP)

( * ) Notice: Subject to any disclaimer, the term of this patent is extended or adjusted under 35 U.S.C. 154(b) by 237 days.

(21) Appl. No.: 12/429,221

(22) Filed: Apr. 24, 2009

(65) Prior Publication Data

US 2009/0285606 A1 Nov. 19, 2009

(30) Foreign Application Priority Data

May 16, 2008 (JP) ..... 2008-129430

(51) Int. Cl.
*G03G 15/08* (2006.01)

(52) U.S. Cl. ..... 399/259; 399/119; 399/262

(58) Field of Classification Search ..... 399/259, 399/119, 262

See application file for complete search history.

(56) References Cited

U.S. PATENT DOCUMENTS 4,862,213 A * 8/1989 Ichihara et al. ..... 399/58
5,383,009 A * 1/1995 Tsusaka ..... 399/111
5,832,347 A * 11/1998 Kawai et al. ..... 430/123.54
2008/0193160 A1* 8/2008 Joo ..... 399/119

FOREIGN PATENT DOCUMENTS

| | | | |
|---|---|---|---|
| JP | S63-113571 | A | 5/1988 |
| JP | H01-267659 | A | 10/1989 |
| JP | 2004-053668 | A | 2/2004 |
| JP | 2005-196044 | A | 7/2005 |
| JP | 2007-093872 | A | 4/2007 |

* cited by examiner

*Primary Examiner* — David Porta
*Assistant Examiner* — Bryan Ready
(74) *Attorney, Agent, or Firm* — Marvin A. Motsenbocker; Mots Law, PLLC

(57) ABSTRACT

An aspect of the invention provides an image forming unit that comprises: a developer container configured to contain a developer; and a developer supplier including at least a developer carrier configured to supply the developer, contained in the developer container, to a latent image formed on an image carrier, wherein: the glass transition temperature of a first developer initially contained in the developer supplier is higher than the glass transition temperature of a second developer contained in the developer container; and the glass transition temperature of the first developer is equal to or lower than 75° C.

12 Claims, 6 Drawing Sheets

IMAGE FORMING UNIT AND IMAGE FORMING APPARATUS

CROSS REFERENCE TO RELATED APPLICATIONS

This application claims priority based on 35 USC 119 from prior Japanese Patent Application No. P2008-129430 filed on May 16, 2008, entitled "Image Forming Unit and Image Forming Apparatus", the entire contents of which are incorporated herein by reference.

BACKGROUND OF THE INVENTION

1. Field of the Invention

The invention relates to an image forming apparatus using an electro-photographic process, such as a printer or a copying machine. In particular, the invention relates to an image forming unit for forming a developed image by supplying toner to an electrostatic latent image formed on a surface of an image carrier.

2. Description of the Related Art

In general, a toner for developing an electrostatic latent image formed on the surface of an image carrier is formulated to have a predetermined glass transition temperature. This glass transition temperature is set to ensure melting of the toner by heat supplied from a fixing unit. In a case where an image forming unit filled with a toner having such a predetermined glass transition temperature is stored for a long period of time, the toner may soften or melt and thus form an adhering or clumping together in a nip formed between a development roller and a development blade, another nip formed between the development roller and a supply roller, or other similar parts. Such a situation may occur, for example, during a period starting with the post-manufacturing quality inspection of the image forming unit, through shipment from the plant, and ending with a user's actual use of the image forming unit.

If an adhering or clumping formed from a softened or melted part of the toner enters a nip formed between, for example, the development roller and the development blade, such material makes a gap between the developing roller and the developing blade. Leakage of the toner from the gap thus formed produces a defective image.

An image forming unit according to the related art includes: a toner container for containing toner; a development roller rotatably supported by this toner container; a sealing member for sealing a longitudinal end portion of a circumferential surface of the development roller by being in contact with the longitudinal end portion of the circumferential surface of the development roller. In this image forming unit, a sealing toner having a glass transition temperature higher than a toner used for development is applied to a contact area between the development roller and the sealing member.

SUMMARY OF THE INVENTION

An aspect of the invention provides an image forming unit that comprises: a developer container configured to contain a developer; and a developer supplier including at least a developer carrier configured to supply the developer, which is contained in the developer container, to a latent image formed on an image carrier. In the image forming unit, the glass transition temperature of a first developer initially contained in the developer supplier is higher than the glass transition temperature of a second developer contained in the developer container, and the glass transition temperature of the first developer is equal to or lower than 75° C.

In the above-described image forming unit, the first developer does not melt at the temperature at which the second developer undergoes glass transition. That is because the glass transition temperature of the first developer initially contained in the developer supplier, which includes at least the development roller and the like, is higher than the glass transition temperature of the second developer contained in the developer container. In addition, because the glass transition temperature of the first developer is equal to or lower than 75° C., the above-described image forming unit is capable of supplying the developer which has suitable fixing properties.

Furthermore, in an image forming apparatus, the first developer does not melt at a temperature at which the second developer undergoes glass transition. That is because the glass transition temperature of the first developer initially contained in the developer supplier included in the image forming unit, which includes the development roller and the like, is higher than the glass transition temperature of the second developer contained in the developer container. In addition, because the glass transition temperature of the first developer is equal to or lower than 75° C., the above-described image forming unit is capable of supplying the developer which has suitable fixing properties. The electrostatic latent image formed on the surface of the image carrier is developed by use of the developer supplied from the image forming unit, and thereby a developer image is formed. The developer image is transferred to a recording medium by the transferrer, and subsequently is fixed by a fixing unit.

DETAILED DESCRIPTION OF EMBODIMENTS

Figure 1:
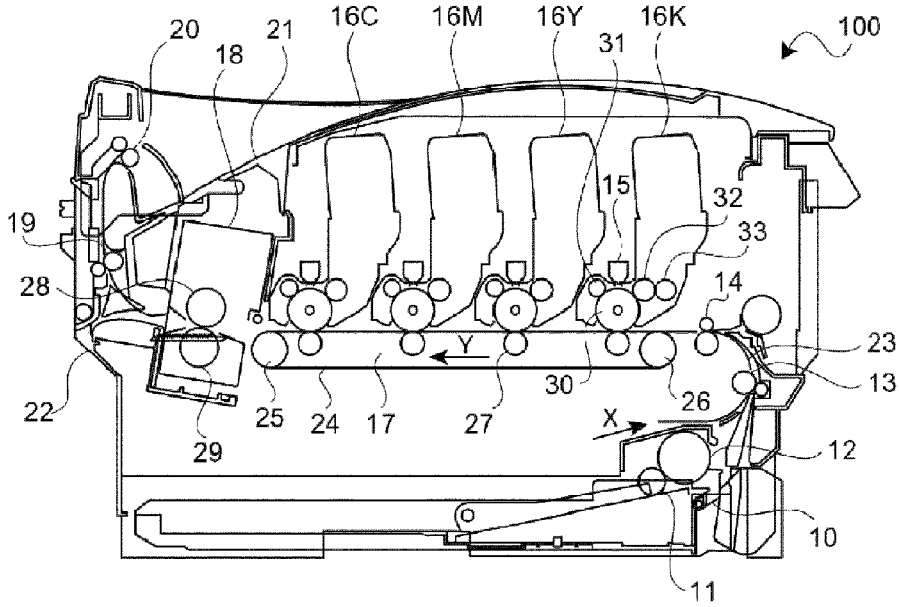
FIG. 1 is a diagram used to explain a chief section of a printer.

Descriptions are provided hereinbelow for embodiments based on the drawings. In the respective drawings referenced herein, the same constituents are designated by the same reference numerals and duplicate explanation concerning the same constituents is basically omitted. All of the drawings are provided to illustrate the respective examples only. No dimensional proportions in the drawings shall impose a restriction on the embodiments. For this reason, specific dimensions and the like should be interpreted with the following descriptions taken into consideration. In addition, the drawings include parts whose dimensional relationship and ratios are different from one drawing to another.

FIG. 1 is a side, cross-sectional view schematically showing a chief section of printer 100 as an image forming unit according to an embodiment of the invention.

For example, printer 100 is configured as a color electrophotographic printer. Printer 100 includes: paper feeding cassette 10 configured to contain sheets P as recording media; exposure units 15 configured to form electrostatic latent images on surfaces of photosensitive drums 30, respectively, which are described later; image forming units 16 (16K, 16Y, 16M, 16C) configured to supply their toners to the electrostatic latent images formed by exposure units 15, thereby to develop the electrostatic latent images, and thus to form toner images, respectively; transfer unit 17 configured to transfer the toner images, which are respectively formed by image forming units 16, onto sheet P; and fixing unit 18 configured to fix the toner images transferred onto sheet P. Printer 100 further includes: conveying rollers 12, 13, 14, 19 configured to convey sheet P to these units; and discharging rollers 20 configured to discharge sheet P into stacker 21 formed in a part of the external housing of printer 100.

Paper feeding cassette 10 contains a stack of sheets P. Paper feeding cassette 10 is detachably installed in the lower part of printer 100. Pickup roller 11 feeds one sheet after another in a direction indicated by an arrow X by successively picking up an uppermost sheet in the stack of sheets P contained in paper feeding cassette 10. Conveying rollers 12, 13, 14 are placed along sheet conveying path 23 formed in lower frame 22. Conveying rollers 12, 13, 14 convey each sheet P, which is fed from paper feeding cassette 10, to image forming units 16 while correcting the orientation of each sheet P in order that each sheet P should not be conveyed diagonally.

Each exposure unit 15 is an LED (Light Emitting Diode) head including: a light emitting element such as an LED; and a lens array. Exposure unit 15 irradiates the surface of corresponding photosensitive drum 30 with light based on inputted print data, and thus forms the electrostatic latent image by photo-induced discharge of an electric potential in an area irradiated with the light.

Image forming units 16 supply their respective toners to the electrostatic latent images formed on the surfaces of photosensitive drums 30 by exposure units 15, and thereby reverse develop the electrostatic latent images. Printer 100 includes four image forming units 16 (16K, 16Y, 16M, 16C) corresponding to the respective toners (black, yellow, magenta and cyan). Image forming units 16 are placed in series along sheet conveying path 23, and are detachably attachable to printer 100. Detailed descriptions are provided for image forming units 16 later.

Transfer unit 17 includes: endless transfer belt 24 configured to transfer sheet P by electrostatic adhesion in a direction indicated by an arrow Y in FIG. 1; driving roller 25 configured to drive transfer belt 24 by being rotated by a driving force from a driver (not illustrated); belt idling roller 26 configured to hold transfer belt 24 in tension by working in conjunction with driving roller 25; and transfer rollers 27 positioned to face and press against photosensitive drums 30 that are provided to image forming units 19(16K, 16Y, 16M, 16C), and configured to transfer the toner images, which are formed on the photosensitive drums 30, onto sheet P, respectively. A bias voltage is applied to each transfer roller 27 from a power supply (not illustrated). Transfer rollers 27 transfer their toner images to sheet P at their predetermined times.

Fixing unit 18 is located downstream of the location of image forming units 16 along sheet conveying path 23, and fixes the toner images transferred onto sheet P. Fixing unit 18 includes heating roller 28, pressure roller 29, a heater (not illustrated) and a thermistor (not illustrated). Heating roller 28 is formed by covering a cored bar with a heat-resisting elastic layer, and subsequently by covering the resultant cored bar with a PFA (tetrafluoroethylene-perfluoro alkylvinyl ether copolymer) tube. The cored bar is made of aluminum or the like, and is shaped like a hollowed cylinder. The heat-resisting elastic layer is made of a silicone rubber or the like. Furthermore, a heater such as a halogen lamp is placed inside of the cored bar. Pressing roller 29 is configured by covering a cored bar with a heat-resisting elastic layer, and subsequently by covering the resultant cored bar with a PFA tube. The cored bar is made of aluminum or the like. The heat-resisting elastic layer is made of silicone rubber or the like. Pressing roller 29 is placed to form a nip with heating roller 28. The thermistor is configured to detect the temperature of the surface of heating roller 28, and is placed in a vicinity of heating roller 28. Information on the temperature detected by this thermistor is transmitted to a temperature controller (not illustrated). On the basis of this information, the temperature controller controls the heater in order that the heater should be turned on and off. Thereby, the temperature controller keeps the temperature of the surface of heating roller 28 at a predetermined temperature.

Discharging rollers 20 include at least a pair of rollers that discharge sheet P, on which the toner images are fixed by fixing unit 18, onto stacker 21.

In addition to including the above-described configuration, printer 100 may include: a display unit including a display such as a LCD (Liquid Crystal Display), and configured to display the operating status of printer 100; and an operator interface unit including a touch panel, and configured to receive instructions from a user.

Printer 100 including the above-described configuration is capable of transferring and fixing the toner images, which are formed by image forming units 16, onto sheet P, and thus of outputting an image to the outside of printer 100 on the basis of the inputted print data.

The foregoing describe a tandem type printer including four color image forming units 16 in series as printing engines. However, the invention is not limited to the printer of the tandem type. The invention can be applied, for example, to printers such as a printer of a four-cycle type using a revolving case in which four color toner cartridges as printing engines are included.

Figure 7:
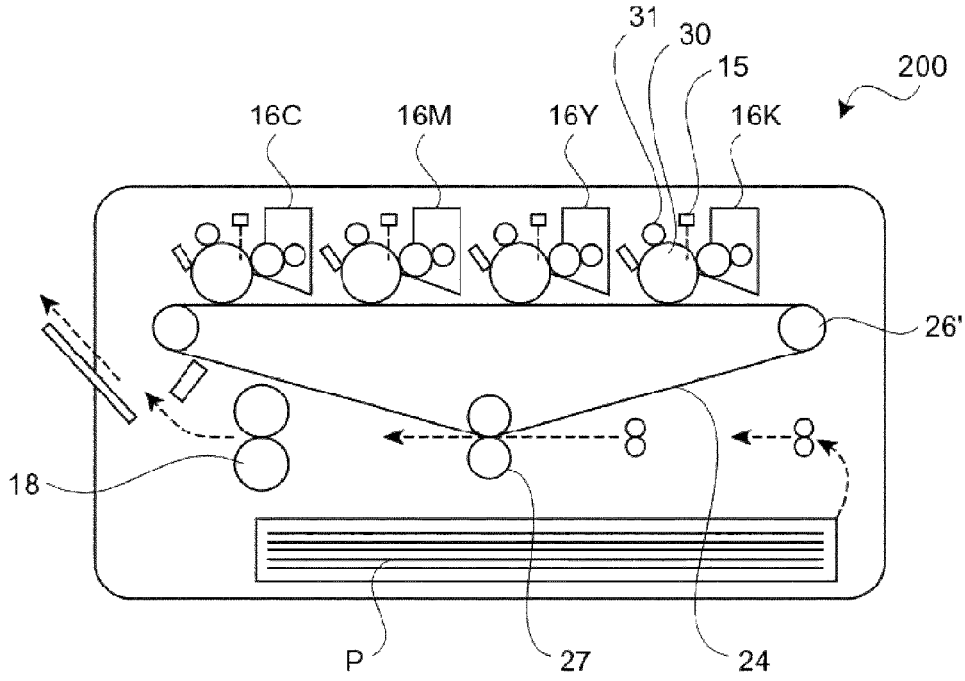
FIG. 7 is a diagram used to explain a chief section of a printer of another embodiment.
Figure 8:
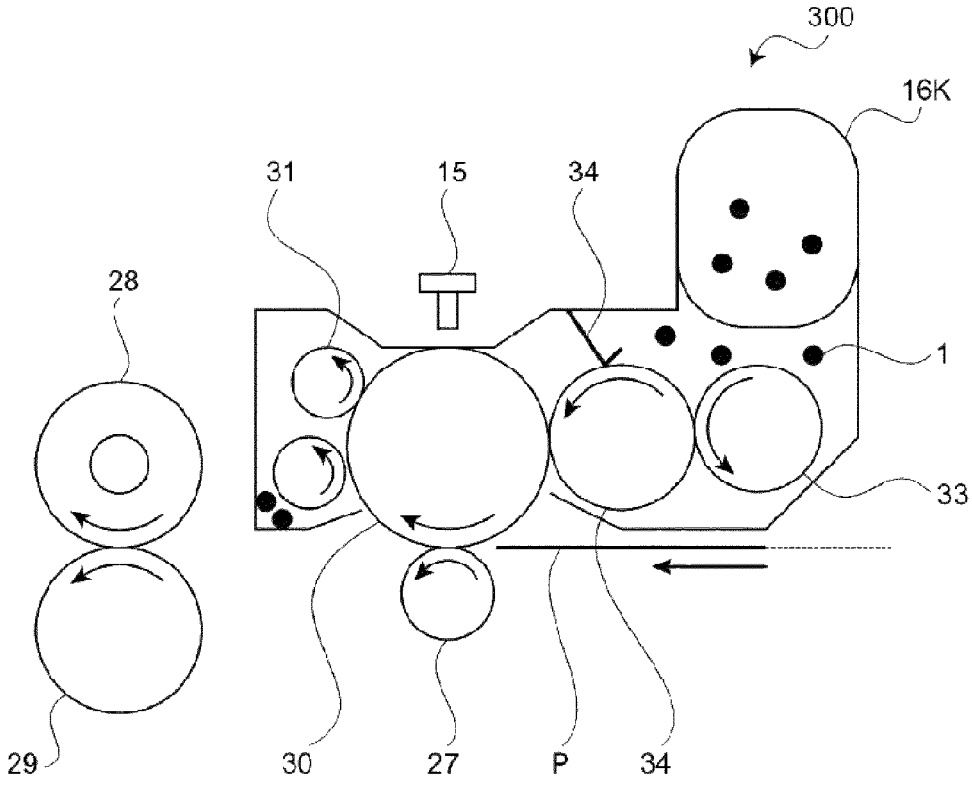
FIG. 8 is a diagram used to explain a chief section of a printer of another embodiment.

From a viewpoint of transfer types, for example, the invention can be applied to printers such as: printer 200 of an intermediate transfer type using an intermediate transfer belt as shown in FIG. 7; printer 300 of a roller type forming a single-colored image as shown in FIG. 8; and a printer including five or more color image forming units.

Figure 2:
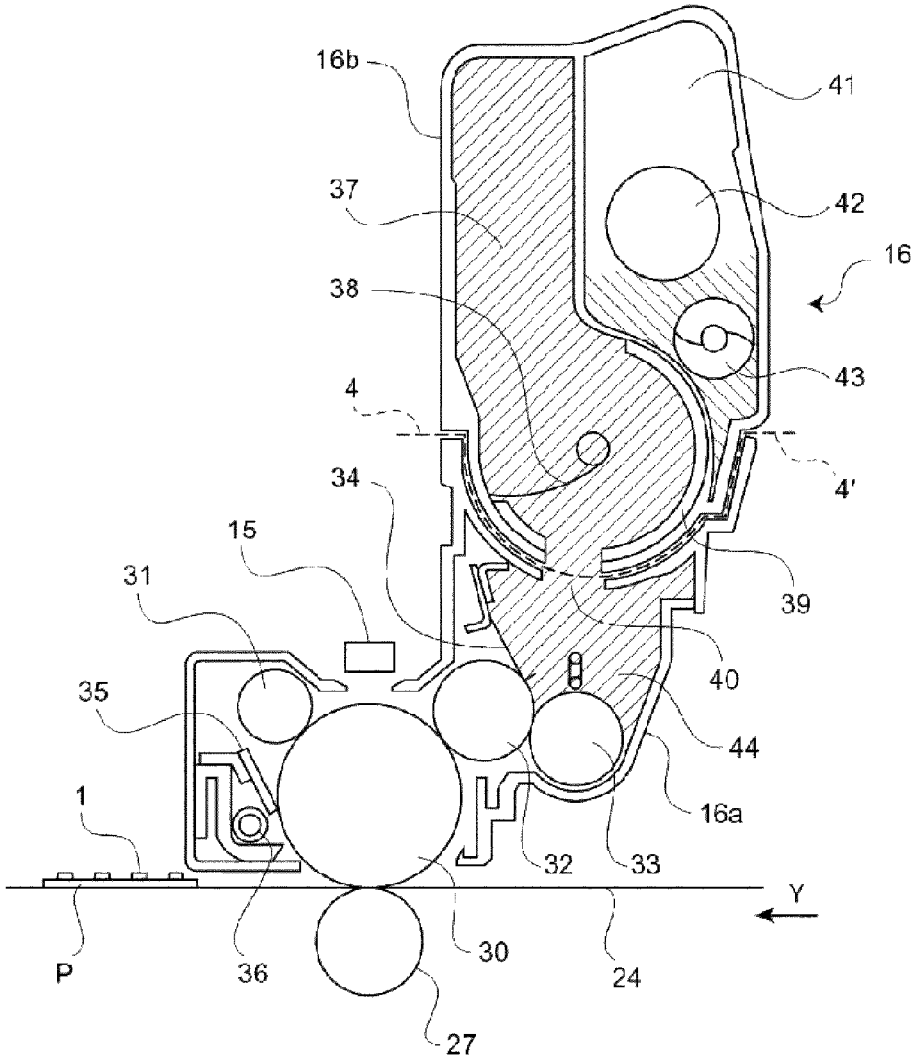
FIG. 2 is a diagram used to explain a chief section of an image forming unit.
Figure 3:
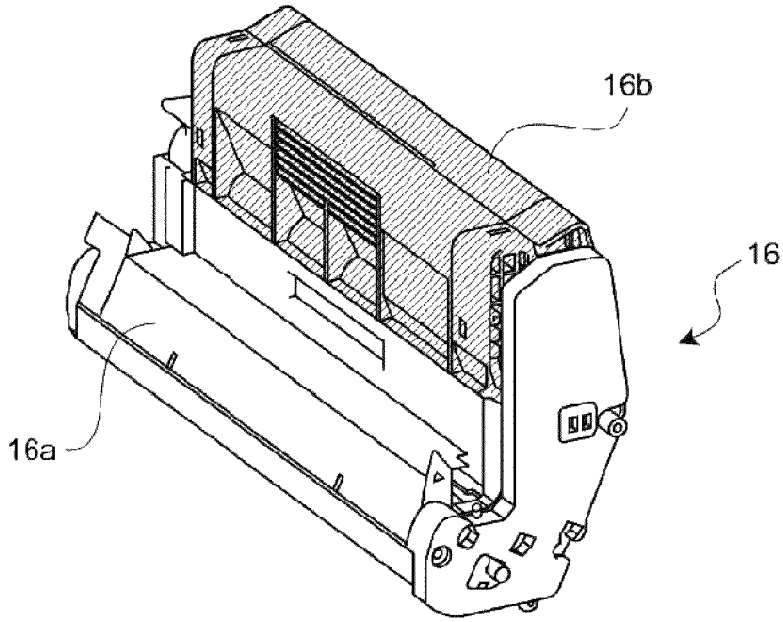
FIG. 3 is another diagram used to explain the chief section of the image forming unit.
Figure 4:
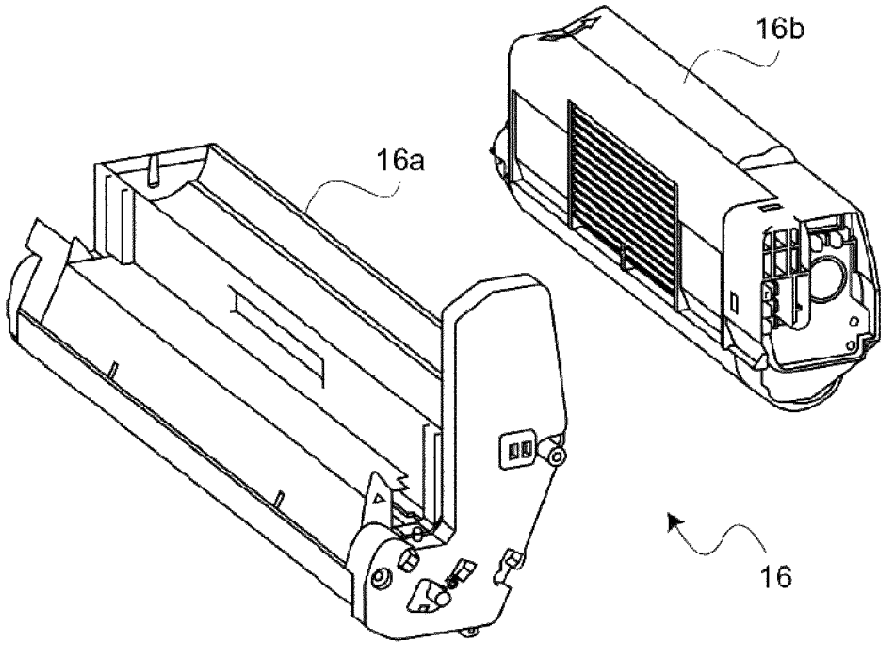
FIG. 4 is yet another diagram used to explain the chief section of the image forming unit.

Next, descriptions are provided for image forming units 16 by use of FIGS. 2, 3 and 4. Image forming units 16 (16K, 16Y, 16M, 16C) form the toner images of the colors (black, yellow, magenta and cyan), respectively. Having such a function, image forming units 16 have the same configuration. Only the colors of the toners contained in image forming units 16 are different from one to another. As shown in FIGS. 2 and 3, each image forming unit 16 includes: toner cartridge 16*b* as a developer container in which toner HQ as a second developer is contained corresponding to one of the colors; and image forming unit main body 16*a* as a developer supplier in which toner HT as a first developer is initially contained, image forming unit main body 16*a* including a development roller 32 and the like. The embodiment is described by giving the example of each image forming unit 16 including image forming unit main body 16*a* and toner cartridge 16*b* which are attachable to and detachable from each other as shown by a broken line 4-4' in FIG. 2.

First of all, descriptions are provided for image forming unit main body 16*a*. Image forming unit main body 16*a* includes: photosensitive drum 30 as an image carrier; charging roller 31 configured to uniformly charge the surface of photosensitive drum 30; development roller 32 as a developer carrier configured to supply photosensitive drum 30 with toner HT or toner HQ; supplying roller 33 as a supplying member configured to supply development roller 32 with toner HT or toner HQ; development blade 34 as a developer layer controlling member configured to control the thickness of toner HT or toner HQ supplied onto development roller 32; cleaning blade 35 configured to scrape a residual portion of toner HT or toner HQ from photosensitive drum 30; and conveyor auger 36 configured to convey waste toner, which is scraped from photosensitive drum 30 by cleaning blade 35, to toner recovery chamber 41 provided in toner cartridge 16*b*.

Photosensitive drum 30 includes an electrically-conductive supporting body and a photovoltaic layer. Photosensitive drum 30 is an organic photoreceptor configured by sequentially laying a charge generation layer and a charge conveying layer on a metal pipe which is made of aluminum or the like. In this respect, the metal pipe constitutes the electrically-conductive supporting body. The charge generation layer and the charge conveying layer constitute the photovoltaic layer. The surface of photosensitive drum 30 is homogeneously and evenly charged by charging roller 31. When a corresponding one of exposure units 15 irradiates the surface of photosensitive drum 30 with light, the electrostatic latent image is formed on the surface of photosensitive drum 30.

Charging roller 31 includes a metal shaft and a semi-conductive rubber layer made of an epichlorohydrin rubber. In addition, charging roller 31 is located in such a way as to contact the surface of photosensitive drum 30, and thus rotates following the rotation of photosensitive drum 30. A power supply (not illustrated) specialized for charging roller 31 is connected to charging roller 31. The power supply is configured to apply a bias voltage to charging roller 31. The polarity of the bias voltage is equal to the polarity of toner HT or toner HQ. Thus, the surface of photosensitive drum 30 is homogeneously and evenly charged by the bias voltage which the power supply specialized for charging roller 31 applies to charging roller 31.

Development roller 32 is configured as a metal shaft covered by a semi-conductive urethane rubber layer. Development roller 32 abuts photosensitive drum 30 with a predetermined amount of contact pressure. Thus, development roller 32 supplies toner HT or toner HQ to the electrostatic latent image formed on photosensitive drum 30, and reverse develops the electrostatic latent image. A power supply (not illustrated) specialized for development roller 32 is connected to development roller 32. The power supply is configured to apply a bias voltage to development roller 32. The polarity of the bias voltage is equal or opposite to the polarity of toner HT or toner HQ. When the power supply 32 applies the bias voltage to development roller 32, development roller 32 is charged. Thus, development roller 32 applies toner HT or toner HQ to an area representing the electrostatic latent image on the photosensitive drum 30.

Supplying roller 33 includes a metal shaft covered with a semi-conductive silicone sponge layer. Supplying roller 33 abuts development roller 32 with a predetermined amount of contact pressure, and thus supplies development roller 32 with toner HT or toner HQ. A power supply (not illustrated) specialized for supplying roller 33 is connected to supplying roller 33. The power supply is configured to apply a bias voltage to supplying roller 33. The polarity of the bias voltage is equal or opposite to the polarity of toner HT or toner HQ. When the power supply 33 applies the bias voltage to supplying roller 33, supplying roller 33 supplies development roller 32 with toner HT or toner HQ.

In this respect, the embodiment uses toner HT whose glass transition temperature is higher than that of toner HQ. For this reason, the toner having the higher glass transition temperature is applied to supplying roller 33. Accordingly, the toner having the higher glass transition temperature is applied to all the pressure-contact areas, excluding a contact area between a sealing part (not illustrated) and the development roller, in each image forming unit. Thereby, the embodiment ensures that each image forming unit is stored more stably than any other scheme in which the toner having the higher glass transition temperature is additionally applied to the contact area between the sealing part (not illustrated) and the development roller.

In general, the glass transition is defined as a generalized second order phase transition of Ehrenfest type between glass and its melt which is supercooled under its melting point. The glass transition temperature is defined as a temperature at which the second order phase transition occurs from glassy condition to rubber condition, or from rubber condition to glassy condition.

Development blade 34 is 0.08 mm in thickness, for example. The length of development blade 34 is almost equal to the longitudinal length of development roller 32. Development blade 34 is a metal, thin-plated member configured to control the thickness of the layer of toner HT or toner HQ in order that the thickness should be kept constant. Development blade 34 is placed such that one longitudinal end thereof is fixed to a frame (not illustrated), and a surface slightly inside of its other longitudinal extremity contacts development roller 32.

Cleaning blade 35 is a urethane rubber member placed in a location such that the edge portion of cleaning blade 35 abuts the surface of photosensitive drum 30. Cleaning blade 35 cleans the surface of photosensitive drum 30 by scraping the residual portion of toner HT or toner HQ from the surface of photosensitive drum 30.

Conveyor auger 36 is a spirally-shaped member configured to convey waste toner, which is scraped off photosensitive drum 30 by cleaning blade 35, to waste toner recovery passage (not illustrated). The waste toner conveyed by conveyor auger 36 is eventually conveyed to, and collected by, toner recovery chamber 41.

Next, descriptions are provided for toner cartridge 16*b*. Toner cartridge 16*b* includes: toner containing chamber 37 configured to contain toner HQ; agitating member 38 configured to agitate the toner contained in toner containing chamber 37; shutter 39 located under toner containing chamber 37; toner recovery chamber 41 configured to contain the waste toner through opening 42; and rotary member 43 configured to convey the waste toner in the longitudinal direction of toner recovery chamber 41 while rotating.

Toner containing chamber 37 is a hollow member configured to contain toner HQ exclusively corresponding to one of the colors. Agitating member 38 is a shaft member molded of a plastic material or the like. In addition, agitating member 38 extends in the longitudinal direction of toner containing chamber 37, and is rotatably supported by toner containing chamber 37. Shutter 39 is placed in a lowermost portion of toner containing chamber 37, and opens and closes at predetermined times. Thus, shutter 39 constitutes lower toner discharging outlet 40. Once shutter 39 opens, a portion of toner HQ contained in toner containing chamber 37 is discharged to toner hopper 44 of image forming unit main body 16*a*. In this respect, toner hopper 44 is a space formed in the inside of image forming unit main body 16*a*, and is configured to hold the toner inside of the image forming unit main body 16*a*. Note that in the embodiment, a predetermined amount of toner HT is initially contained in toner hopper 44. Once a toner sensor (not illustrated) detects toner hopper 44 running short of the toner, shutter 39 is opened so an adequate amount of toner HQ is supplied from toner containing chamber 37 to toner hopper 44.

Toner recovery chamber 41 is a hollow member configured to receive the waste toner, which is conveyed from the waste toner recovery passage, through opening 42, and thus to contain it. Rotary member 43 is a spirally-shaped member molded of a plastic material or the like. In addition, rotary member 43 extends in the longitudinal direction of toner recovery chamber 41, and is rotatably pivotally supported by toner recovery chamber 41.

The embodiment has been described by giving the example of image forming unit 16 including image forming unit main body 16*a* and toner cartridge 16*b* which are detachably attachable to each other. However, the invention is not limited to this example. For example, the invention can be applied to image forming units such as an image forming unit of an ID-cartridge integrated type in which image forming unit 16*a* and toner cartridge 16*b* are integrated as a single unit. In addition, the embodiment has been described by giving the example of the image forming unit main body 16*a* of an integration type in which the drum unit including the photosensitive drum and the development unit including the development roller are integrated as a single unit. Nevertheless, the invention can be applied to an image forming unit main body of a separation type in which the drum unit and the development unit are separated bodies.

Next, descriptions are provided for how printer 100, including image forming units 16 described above, carries out its printing operation. The printing operation is described with "toner HT or toner HQ" being generically referred to as "toner 1," because the selection of toner HT or toner HQ depends on nothing more than the difference between the timing of when toner HT is used for the printing operation and the timing of when toner HQ is used for the printing operation. To begin with, once information on an image is input into printer 100 through an interface (not illustrated), a main controller (not illustrated) instructs the temperature controller (not illustrated) to control the temperature of the surface of heating roller 28 in order that the temperature thereof should become equal to a predetermined temperature. In addition, the main controller instructs a paper feed controller (not illustrated) to feed sheet P. Once receiving the instruction, the paper feed controller rotates pickup roller 11, and thus feeds sheet P from paper feeding cassette 10 in the direction indicated by the arrow X in FIG. 1. Subsequently, conveying roller 12, 13, 14 placed along sheet conveying path 23 convey sheet P to image forming units 16 while correcting the orientation of sheet P in order that sheet P should not be conveyed diagonally.

While sheet P is being conveyed by conveying rollers 12, 13, 14 with the orientation of sheet P being corrected in order that sheet P should not be conveyed diagonally, the image forming process is started. Once sheet P reaches a predetermined position on sheet conveying path 23, photosensitive drums 30 begin to rotate at a specified circumferential speed. Charging rollers 31 located in contact with the surfaces of photosensitive drums 30 apply the bias voltages, which are supplied by the power supplies specialized for the charging rollers, to photosensitive drums 30, respectively. Thereby, the surfaces of photosensitive drums 30 are homogeneously and evenly charged. Thereafter, exposure units 15 facing photosensitive drums 30 irradiate the surfaces of photosensitive drums 30 with the light based on the inputted information on the image. Thus, exposure units 15 form the electrostatic latent images on the surfaces of photosensitive drums 30 by photo-induced discharge of the electric potentials in the areas irradiated with the light, respectively.

Toners 1 are supplied from development rollers 32 to the electrostatic latent images formed on the surfaces of photosensitive drums 30, respectively. Thereby, the toner images are formed on the surfaces of photosensitive drums 30. The toner images formed on photosensitive drums 30 are transferred onto sheet P by transfer rollers 27 to which the power supplies (not illustrated) specialized for the transfer rollers supply the bias voltages, respectively. Thereby, while sheet P is being conveyed in the direction indicated by the arrow Y in FIG. 1, the toner images respectively formed by image forming units 16K, 16Y, 16M, 16C are sequentially transferred onto sheet P.

Sheet P onto which all the toner images are transferred is conveyed to fixing unit 18. After that, sheet P is conveyed to the nip formed between pressure roller 29 and heating roller 28 whose temperature is controlled in order that the temperature should be equal to a predetermined temperature. At this time, toners 1 on sheet P are melted with the heat of heating roller 28. Subsequently, the melted toners 1 are pressed in the nip. Thereby, the toner images are fixed onto sheet P.

Sheet P onto which the toner images are fixed by fixing unit 18 is further conveyed by conveying roller 19, and is thus discharged onto stacker 21 by discharging rollers 20. With this, the printing operation is ended.

Next, descriptions are provided for a method of manufacturing toner HT and toner HQ according to the embodiment. As described above, toner HT is contained initially in toner hoppers 44 in image forming unit main bodies 16*a*. On the other hand, toner HQ is contained in toner containing chambers 37 in toner cartridges 16*b*. Toners whose glass transition temperatures are different from each other are used as the toners according to the embodiment (toner HT has glass transition temperature Tg1, whereas toner HQ has glass transition temperature Tg2).

Toner HT contains a binder resin which is the same binding resin as in toner HQ, a charge controlling agent, a release agent and an external additive. Toner HT and toner HQ are 8 μm in volume mean particle diameter. Toner HT and toner HQ may be manufactured by polymerization method such as suspension polymerization, emulsion polymerization or dispersion polymerization, otherwise by a pulverization method.

In a case where the pulverization method is used, for example, the toner can be produced as follows. First, the charge controlling agent and the release agent are added to the binder resin containing at least a coloring agent, followed by evenly blending by use of a Henschel mixer or the like. Subsequently, the blended material is kneaded by a biaxial extruder for a predetermined length of time. After cooling the kneaded material, a coarse pulverization-fine pulverization process is applied to the kneaded matter, followed by a classification process. Afterward, the external additive is added to the processed material.

In this respect, synthetic resins generally used as the toner resins can be used solely or in combination as the binder resins contained in the toner of the embodiment. Examples of the synthetic resins which can be contained in the toner of the embodiment include: styrene resins (monopolymer or copolymer which contains styrene or a styrene substitution product) such as polystyrene, poly-α-methyl styrene, chloropolystyrene, styrene-chlorostyrene copolymer, styrene-propylene copolymer, styrene-butadiene copolymer, styrene-vinyl chloride copolymer, styrene-vinyl acetate copolymer, styrene-maleic acid copolymer, styrene-acrylic ester copolymer, styrene-methacrylate ester copolymer, styrene-acrylic ester-methacrylate ester copolymer, styrene-α-chloro acrylic methyl copolymer, styrene-acrylonitrile-acrylic ester copolymer, and styrene-vinyl methyl ether copolymer; polyester resins; epoxy resins; urethane-modified epoxy resins; silicone-modified epoxy resins; vinyl chloride resins; rosin-modified maleic resins; phenyl resins; polyethylene; polypropylene; ionomer resins; polyurethane resins; silicone resins; ketone resins; ethylene-ethyl acrylate copolymer; xylene resins; polyvinyl butyral resins; terpene resins; phenolic resins; and aliphatic and cycloaliphatic hydrocarbon resins.

Out of these binder resins, styrene-acrylic ester copolymer is used as the binder resin for the embodiment. In the case where styrene-acrylic ester copolymer is used as the binder resin, the glass transition temperature can be controlled by controlling the compounding ratio of styrene. Specifically, in the case where the glass transition temperature is raised, the compounding ratio of styrene is increased. Otherwise, by doing things such as adding a component having a larger average molecular weight to the binder resin, the glass transition temperature can be controlled in order that the glass transition temperature should be raised.

In the case where, for example, a polyester resin is used as the binder resin, terephthalic acid, maleic acid, fumaric acid, trimellitic acid or the like can be used as the acid monomer component, whereas a bisphenol-A derivative, ethylene glycol, propylene glycol or the like can be used as the alcohol monomer component. In the case where a polyester resin is used as the binder resin, the degree of dispersion is larger, because the polymerization process is reversible so that partial dissociation occurs in the course of the polymerization process. For this reason, the glass transition temperature can be raised by doing things such as increasing the average molecular weight of the polyester resin, increasing the degree of dispersion of the polyester resin further, or increasing the molecular weight of the acid monomer component or the alcohol monomer component.

Coloring agents generally used as the toner coloring agents can be used as the coloring agents contained in the toner of the embodiment. Pigments, dyes and the like conventionally used as the black, yellow, magenta and cyan toner coloring agents can be used as the coloring agents contained in the toner of the embodiment. Examples of the coloring agents which can be contained in the toner of the embodiment include carbon black, phthalocyanine blue, permanent brown FG, brilliant first scarlet, pigment green B, Rhodamine B base, solvent red 49, solvent red 146, pigment blue 15:3, solvent blue 35, Quinacridone, carmine 6B, and disazo yellow.

Release agents generally used as the toner release agents can be used as the release agent contained in the toner of the embodiment. Examples of the release agent which can be contained in the toner of the embodiment include: aliphatic hydrocarbon-type waxes (such as low-molecular-weight polyethylene, low-molecular-weight polypropylene, olefin copolymers, microcrystalline wax, paraffin wax and microcrystalline wax, paraffin wax and Fischer-Tropsch wax); oxides of aliphatic hydrocarbon-type waxes (such as polyethylene oxide wax) and block copolymers thereof; waxes essentially containing fatty acid esters (such as carnauba wax and montanic ester wax); and products obtained by partially or wholly deacidifying fatty acid esters (such as deacidified carnauba wax). In addition, examples of the release agent include: saturated straight-chain fatty acids (such as palmitic acid, stearic acid, montanic acid, long-chain, or alkyl carboxylic acids containing longer-chain alkyl group); unsaturated fatty acids (such as brassidic acid, eleostearic acid and parinaric acid); saturated alcohols (such as stearyl alcohol, aralkyl alcohol, behenyl alcohol, carnaubyl alcohol, ceryl alcohol, melissyl alcohol, or long-chain alkyl alcohols containing longer-chain alkyl group); polyhydric alcohols (such as sorbitol); fatty acid amides (such as amide linoleate, amide oleate and amide laurate); saturated fatty acid bisamides (such as methylenebis amide stearate, ethylenebis amide caprate, ethylenebis amide laurate and hexamethylenebis amide stearate); unsaturated fatty amides (such as ethylenebis oleic acid amide, hexamethylenebis oleic acid amide, N,N'-dioleyl adipic acid amide and N,N'-dioleyl sebacic acid amide); aromatic bisamides (such as m-xylenebis stearic acid amide and N,N'-distearyl isophthalic acid amide); waxes obtained by grafting aliphatic hydrocarbon-type waxes with vinyl-type monomers such as styrene and acrylic acid; partially esterified compounds of fatty acids and polyhydric alcohols (such as behenic monoglyceride); and methyl ester compounds each containing a hydroxyl group obtained by hydrogenating vegetable oil.

Charge controlling agents generally used as the toner charge controlling agents can be used as the charge controlling agent contained in the toner of the embodiment. Examples of the charge controlling agent which can be contained in the toner of the embodiment include oil black, oil black BY, BONTRON (trademark) S-22 and S34 (Orient Chemical Industries, Ltd.), salicylic metal complexes E-81 and E-84 (Orient Chemical Industries, Ltd), thioindigo-type pigments, sulfonyl amine derivatives of copper phthalocyanine, Spilon Black TRH (Hodogaya Chemical Co., Ltd.), calixarene compounds, organic boron compounds, fluorine-containing quaternary ammonium salt compounds, monoazo metal complexes, aromatic hydroxyl-carboxylic acid type metal complexes, aromatic dicarboxylic acid type metal complexes, and polysaccharides.

Organic and inorganic external additive generally used as the toner external additives can be used as the external additive contained in the toner of the embodiment. Examples of the external additive which can be contained in the toner of the embodiment include: silica particles (such as silica particles produced from a halide of silicon or the like through a dry process or silica particles separated out from a silicon compound in a fluid through a wet process); as well as fine particles of titanium dioxide, alumina, zinc oxide, magnesium fluoride, silicon carbide, boron carbide, f titanium carbide, zirconium carbide, boron nitride, titanium nitride, zirconium nitride, zirconium oxide, magnetite, molybdenum disulfide, aluminum stearate, magnesium stearate, zinc stearate, calcium stearate, metal salts of titanic acids (such as fine particle strontium titanate), and metal salts of silicon. These fine particles are preferably subjected to a hydrophobic treatment by use of a silane coupling agent, a titanium coupling agent, titanium coupling agent, a higher fatty acid, or the like before used. Other examples of a resin fine particle include acrylic resin, styrene resin, fluororesin, and the like.

The colors respectively of toner HT and toner HQ may be controlled in order that the colors should be different from each other. In the case where, however, the colors are controlled in order that the colors should be different from each other, it is likely that the colors may be mixed together, and consequently that it maybe difficult for initial images to offer a desirable color representation when the initial images are formed. Furthermore, in the case where, for example, toner HT is white or transparent, the following problems occur. First, it becomes difficult to check on the operations of image forming units 16 when the performances of image forming units 16 are tested. Second, the densities of the initial images decrease while the initial images are formed.

For these reasons, it is desirable that the colors respectively of toner HT and toner HQ should be controlled in order that toner HT and toner HQ should have the same color. In the case where toner HT and toner HQ have the same color, for example, image forming units 16 can be shipped while contained in the package as they are after the performances of image forming units 16 are tested. Moreover, when the toner HT and toner HQ have the same color, it is possible to prevent things such as change in the tone of the image and reduction in the density of the image.

The glass transition temperatures respectively of toner HT and toner HQ thus manufactured can be measured, for example, in accordance with ASTM (American Society for Testing and Materials) D3418-82, "Standard Test Method for Transition Temperature of Polymers By Thermal Analysis," by use of a high-precision differential scanning calorimeter such as the DSC-7 (manufactured by Perkin-Elmer Inc.)

EXAMPLE 1

To begin with, the inventors examined conditions which cause each toner HT and its paired toner HQ to adhere to, or clump together, things such as the nip formed between development roller 32 and development blade 34 by evaluating the storage stabilities and fixing properties of each toner HT and its paired toner HQ. When the conditions which cause each toner HT and its paired toner HQ to adhere to, or clump together, the nip and the like are examined with the glass transition temperature Tg2 of toner HQ being temporarily set at 60° C., it is possible to determine the desirable temperature range of the glass transition temperature Tg1 of toner HT.

First, image forming units 16 are each prepared in a way that toner cartridge 16*b* contains a predetermined amount of toner HQ with glass transition temperature Tg2 set at 60° C., and that image forming unit main body 16*a* contains 5 g of toner HT with glass transition temperature Tg1 set in a range of 56° C. to 78° C. as shown in Table 1. Then, the image forming units 16 are stored under conditions of a temperature of 50° C. and a humidity of 20% for two months. After the two months of the storage, for each image forming unit 16, the storage stabilities and fixing properties of toner HT and its paired toner HQ are evaluated. Note that each image forming unit 16 is kept at low humidity because image forming unit 16 is put into a package with silica gel as a desiccant before image forming unit 16 is shipped from the factory. For this reason, the storage stabilities and fixing properties of each toner HT and its paired toner HQ are evaluated under the foregoing storage conditions.

The storage stabilities of each toner HT and its paired toner HQ are evaluated on the basis of how many defected images are formed with the toners under the following test conditions. Image forming units 16 kept under the foregoing storage conditions are respectively installed in printers 100. Subsequently, by use of each printer 100 with image forming unit 16 thus installed, 1000 copies of an image are printed on A-4 size sheets with a density of 3% of an image density (100% solid image) with which the image is formed on the entire printable area of each A-4 size sheet with a printable density. In terms of the storage stabilities, toner HT and its paired toner HQ are evaluated as desirable and marked with "G" (good), if the first 100 copies of the image printed with the toners include no more than 15 defected images having white lines, voids and the like which occur due to clumped materials and the like. On the other hand, toner HT and its paired toner HQ are evaluated as poor and marked with "P" (poor), if the first 100 copies of the image printed with the toners include more than 15 defected images having white lines.

The fixing properties of each toner HT and its paired toner HQ are evaluated as the following test conditions. Each time 10 copies of the image are printed with the density of 3% during the above-described evaluation of the storage stabilities of each toner HT and its paired toner HQ, a routine image including characters, figures and the like is printed with the toners. Subsequently, a 10-cm-long adhesive tape is applied to an arbitrary area on the surface of the printed routine image, and the adhesive tape is peeled off the surface. Thereafter, it is observed by use of a microscope whether or not the routine image is transferred onto the peeled-off adhesive tape. The evaluation is made on the basis of this observation. In terms of the fixing properties, toner HT and its paired toner HQ are evaluated as desirable and marked with "G" (good) in a case where no routine image formed with the toners is transferred onto the peeled-off adhesive tape. On the other hand, toner HT and its paired toner HQ are evaluated as poor and marked with "P" (poor) in a case where the routine image formed with the toners is transferred onto the peeled-off adhesive tape.

Table 1 shows the result of evaluating the storage stabilities and fixing properties of each toner HQ and its paired toner HT.

TABLE 1

| | Tg1 [° C.] | | | | | | | | |
|---|---|---|---|---|---|---|---|---|---|
| | 56 | 60 | 62 | 64 | 67 | 70 | 72 | 75 | 78 |
| | Tg2 [° C.] 60 | | | | | | | | |
| Storage Stabilities | P | P | P | G | G | G | G | G | G |
| Fixing Properties | G | G | G | G | G | G | G | G | P |

The result of evaluation of the storage stabilities shows that no defected image is observed as being formed when toner HT with glass transition temperature Tg1 of 64° C. or higher is used, and that no toner HT is observed as clumping due to frictional sliding in the nip part when glass transition temperature Tg1 is equal to or higher than 64° C. In addition, when glass transition temperature Tg1 is equal to or higher than 64° C., no toner HT is observed as adhering to the nip. In summation, toner HT whose glass transition temperature Tg1 is equal to or higher than 64° C. exhibits a desirable evaluation result. On the other hand, the result of evaluation of the fixing properties shows that toner HT is observed as causing cold offset when toner HT with glass transition temperature Tg1 of 78° C. is used. Through these evaluations, it becomes clear that it is desirable that a toner whose glass transition temperature Tg1 is not lower than 64° C. but not higher than 75° C. should be used.

On the basis of the temperature range of glass transition temperature Tg1 which is determined for toner HT through the above-mentioned evaluations, a desirable temperature range of glass transition temperature Tg2 is determined for toner HQ by using the following evaluation items as indices. The evaluation items include: "initial clumped materials," "initial developer fluidity," "initial copies of an image," and "copies of an image with time."

First of all, image forming units 16 each including toner cartridge 16*b* containing a predetermined amount of toner HQ with glass transition temperature Tg2 and image forming unit main body 16*a* containing 5 g of toner HT with glass transition temperature Tg1 are installed in printer 100, and are left under conditions of a temperature of 50° C. and a humidity of 55% for 24 hours. After that, image forming units 16 make prints of 1000 copies of a predetermined image. Here, glass transition temperature Tg2 is set to degrees within a range of 50° C. to 68° C. as shown in Table 2, glass transition temperature Tg1 is set to 64° C., 70° C. and 75° C., and each pair of glass transition temperatures Tg1 and Tg2 are evaluated.

For each group of image forming units 16, in terms of the "initial clumped materials," toner HT and its paired toner HQ are evaluated on the basis of how many defected images each including white lines, voids and the like are formed with the toners due to clumped materials out of the first 30 printed copies of the image. In terms of the "initial clumped materials," toner HT and its paired toner HQ are evaluated as desirable and marked with a circle, if the first 30 copies of the image printed with the toners include no defected copy.

For each groups of image forming units 16, in terms of the "initial developer fluidity," toner HT and its paired toner HQ are evaluated on the basis of whether or not the image density becomes uneven, and whether or not the image density decreases suddenly, in the first 30 printed copies of the image due to the toners bridging in image forming unit 16. In this respect, the term "bridging" means that toner particles stick together due to things such as an electrostatic attractive force, and that aggregations of toner particles are accordingly formed. In terms of the "initial developer fluidity," toner HT and its paired toner HQ are evaluated as desirable and marked with "G" (good), if no toners bridges, and as poor and marked with "P" (poor), if toners bridges.

For each group of image forming units 16, in terms of the "initial copies of an image," toner HT and its paired toner HQ are evaluated on the basis of how many copies of the image out of the first 30 printed copies are affected by cold offset or poor fixation of the toners due to abrasion of the fixing members, such as heating roller 28, constituting fixing unit 18. In terms of the "initial copies of an image," toner HT and its paired toner HQ are evaluated as desirable and marked with "G" (good), if no initial copy of the image is affected by cold offset and poor fixation of the toners. On the other hand, toner HT and its paired toner HQ are evaluated as poor and marked with "P" (poor), if initial copy of the image is affected by cold offset or poor fixation of the toners is occurred.

For each group of image forming units 16, in terms of the "copies of an image with time," toner HT and its paired toner HQ are evaluated on how many copies of the image are affected by the toners which are poorly transferred and conveyed when parts of the toners adhere to the nip through their pressure application, or by image defects including white lines, voids and the like which occur due to aggregations which are separated from the adhered parts of the toners, each time 100 copies of the image are printed. In terms of "copies of an image with time", toner HT and its paired toner HQ are evaluated as desirable and marked with "G" (good), if each 100 printed copies of the image include no more than 10 defective copies of the image affected by the poor transfer and conveyance of the toners as well as the image defects. On the other hand, toner HT and its paired toner HQ are evaluated as poor and marked with "P" (poor), if each 100 printed copies of the image include more than 10 defective copies of the image affected by the poor transfer and conveyance of the toners as well as the image defects.

Tables 2, 3 and 4 show the results of the above-described evaluations. Table 2 shows the result of evaluating toners HQ and their paired toners HT which are used in the case where glass transition temperatures Tg2 are set different among toners HQ in the range of 50° C. to 68° C. whereas glass transition temperature Tg1 is set at 64° C. for each toner HT. Table 3 shows the result of evaluating toners HQ and their paired toners HT which are used in the case where glass transition temperatures Tg2 are set different among toners HQ in the range of 50° C. to 68° C. whereas glass transition temperature Tg1 is set at 70° C. for each toner HT. Table 4 shows the result of evaluating toners HQ and their paired toners HT which are used in the case where glass transition temperatures Tg2 are set different among toners HQ in the range of 50° C. to 68° C. whereas glass transition temperature Tg1 is set at 75° C. for each toner HT.

TABLE 2

| | Tg1 [° C.] 64 Tg2 [° C.] | | | | | | |
|---|---|---|---|---|---|---|---|
| | 50 | 53 | 56 | 60 | 62 | 64 | 68 |
| Initial Clumped Materials | P | G | G | G | G | G | G |
| Initial Developer Fluidity | P | P | G | G | G | G | G |
| Initial Copies of an Image | G | G | G | G | G | P | P |
| Copies of an Image with Time | P | P | G | G | G | P | P |

TABLE 3

| | Tg1 [° C.] 70 Tg2 [° C.] | | | | | | |
|---|---|---|---|---|---|---|---|
| | 50 | 53 | 56 | 60 | 62 | 64 | 68 |
| Initial Clumped Materials | P | G | G | G | G | G | G |
| Initial Developer Fluidity | P | P | G | G | G | G | G |
| Initial Copies of an Image | G | G | G | G | G | G | P |
| Copies of an Image with Time | P | P | G | G | G | P | P |

TABLE 4

| | Tg1 [° C.] 75 Tg2 [° C.] | | | | | | |
|---|---|---|---|---|---|---|---|
| | 50 | 53 | 56 | 60 | 62 | 64 | 68 |
| Initial Clumped Materials | P | G | G | G | G | G | G |
| Initial Developer Fluidity | P | G | G | G | G | G | G |
| Initial copies of an Image | G | G | G | G | G | G | P |
| Copies of an Image with Time | P | P | G | G | G | P | P |

In the case where toner HQ with glass transition temperature Tg2 of 50° C. is used, the toner is observed as clumping under all the conditions. One may consider the reason for this clumping is that the toner with a glass transition temperature close to 50° C. undergoes glass transition because the temperature inside printer 100 in operation is 50° C. By contrast, no toner HQ with glass transition temperature Tg2 higher than 50° C. is observed as clumping (See Tables 2, 3 and 4, "Initial Clumped materials").

In the case where toner HQ with glass transition temperature Tg2 of 50° C. is used, the toner is poorly conveyed, and the densities of the transferred images are uneven, due to the bridging of the toner. One may consider the reason for the poor conveyance and uneven densities is that the toner whose glass transition temperature Tg2 is relatively low decreases its fluidity because of separation of the external additive from the toner (see Tables 2, 3 and 4, "Initial Developer Fluidity"). In addition, in the case where toner HQ with glass transition temperature Tg2 of 53° C. is used, the result of evaluation of toner HT with glass transition temperature Tg1 of 64° C. is the same as the result of evaluation of toner HT with glass transition temperature Tg1 of 70° C. in terms of the initial fluidity of the developer (see Table 2 and 3, "Initial Developer Fluidity").

Furthermore, in the case where toner HQ with glass transition temperature Tg2 of 68° C. is used, under all the conditions, cold offset occurs in the initial printed copies of the image, and the toner is poorly fixed onto the initial printed copies of the image due to abrasion of the fixing members, such as heating roller 28, constituting fixing unit 18. One may consider the reason for the cold offset and poor fixation is that glass transition temperature Tg2 is relatively high (see Table 2, 3 and 4, "Initial Copies of an Image"). Moreover, under the condition that toner HT with glass transition temperature Tg1 of 64° C. is used, the result of evaluation of toner HQ with glass transition temperature Tg2 of 64° C. is also the same as the result of evaluation of toner HT with glass transition temperature Tg2 of 68° C. in terms of the initial copies of the image (see Table 2, "Initial Copies of an Image").

Additionally, in the case where toners HQ with their respective glass transition temperatures 50° C., 53° C., 64° C. and 68° C. are used, under all the condition, the toners are poorly transferred and conveyed because parts of the toners adheres to the nip part through their pressure application, and defective copies of the image including white lines, voids and the like occur due to aggregations which are separated from the adhered parts of the toners (see Tables 2, 3 and 4, "Copies of an Image with Time").

These evaluations make it clear that it is desirable that a toner whose glass transition temperature Tg2 is not lower than 56° C. but not higher than 62° C. should be used as toner HQ.

Consequently, Example 1 inhibits the toners from turning into adhering matters or clumped materials, and reduces the possibility that image defect including faded parts, white lines and the like may occur, no matter what storage environments and distribution conditions the toners may be stored in.

EXAMPLE 2

It is possible to enhance the storage stabilities of the toners when toner HT whose glass transition temperature Tg1 is higher than glass transition temperature Tg2 is used. However, depending on the storage environments and distribution conditions, it is still likely that part of the external additive may be separated from the toners because the toners are applied to the nip formed, for example, between development roller 32 and development blade 34 by pressing the toners, otherwise because the toners frictionally slide against the nip part. When the separated part of the external additive adheres to other members, it is likely that the separated part of the external additive may defectively electrostatically charge those members, and that this defective electrostatic charge accordingly may cause faded parts on initial copies of images which are printed immediately after the printing operation is started. One may consider the reason for this separation is that the external additive tends to freely release its portion because a toner with a relatively high glass transition temperature has so weak an elastic force that its anchoring effect is weak.

With this taken into consideration, the inventors examined the amount of the external additive which does not deteriorate the storage stability of the toners, and which concurrently reduces the possibility that image defect including faded parts, white lines and the like may occur in printed copies during print image formation.

[Optimization of the Amount of External Additive Contained in Toner HQ]

To begin with, toners HQ are produced in a way that the amounts of external additive added to the base particles of toner HQ are 1.5% by weight, 2.0% by weight, 2.5% by weight, 2.9% by weight, 3.3% by weight and 3.7% by weight, respectively. Image forming units 16 containing toners HQ produced with the different densities of external additive are installed in printers 100, respectively. Subsequently, by use of each printer 100 with image forming unit 16 thus installed, copies of an image are printed on sheets with an image density (100% solid image) with which the image is formed on the entire printable area of each sheet with a printable density. Thereafter, for each amount of external additive, the density of printed copies of the image is measured. The density of the printed copies of the image is measured by use of X-Rite 528 Spectrodensitometer (manufactured by X-Rite, Incorporated).

Figure 5:
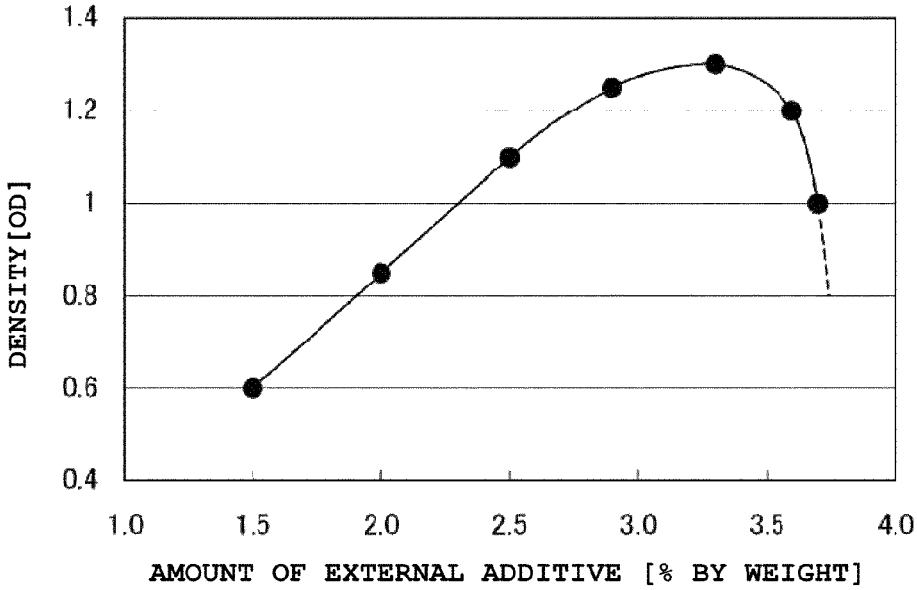
FIG. 5 is a diagram showing a relationship between an amount (% by weight) of external additive and a value representing density of a printed image.

Table 5 and FIG. 5 show the result of the measurement. Table 5 shows a relationship between each amount of external additive (% by weight) and its corresponding density (OD; standing for Optical Density) of the printed copies of the image. FIG. 5 graphically shows the relationship shown in Table 5. As is clear from Table 5 and FIG. 5, as the amount of external additive increases, the amount of toner developed onto photosensitive drum 30 increases because the electric potential rises due to triboelectric charging. Accordingly, the density of the printed copies of the image increases. However, as the amount of external additive increases too much, the density of the printed copies of the image decreases. That is because part of the external additive is separated from toner HQ and the separated part of the external additive adheres to development roller 32 and the like. The separation and adhesion cause the layer of toner HQ to be formed in defective thicknesses, and causes apparatus members to be electrostatically charged defectively.

TABLE 5

| | Amount of External Additive [%] | | | | | | |
|---|---|---|---|---|---|---|---|
| | 1.5 | 2 | 2.5 | 2.9 | 3.3 | 3.6 | 3.7 |
| Density [OD] | 0.6 | 0.85 | 1.1 | 1.25 | 1.3 | 1.2 | 1 |

The experiment gives a result that when the amount of external additive added to the base particles of toner HQ is 3.3% by weight, the density of the printed copies of the image is optimal. On the basis of the result, the inventors determine that the amount of external additive used for toner HQ should be 2.9% by weight to 3.6% by weight (preferably, 2.9% by weight to 3.3% by weight).

[Optimization of the Amount of External Additive Contained Toner HT]

To begin with, toners HT are produced in a way that the differences between the predetermined amount of external additives contained in toner HQ and the amount of external additives contained in toner HT are −0.3% by weight, −0.5% by weight, −0.7% by weight, −1.0% by weight and −1.2% by weight, respectively. Image forming units 16 containing 5 g of toners HT produced with the different densities of external additive and the predetermined amount of toner HQ are installed in printers 100, respectively. Subsequently, by use of each printer 100 with image forming unit 16 thus installed, 100 copies of an image are printed on sheets with an image density (100% solid image) with which the image is formed on the entire printable area of each sheet with a printable density. Thereafter, for each amount of external additive contained in toner HT, the density of initial printed copies of the image is measured immediately after the printing operation is started. The density of the initial printed copies of the image is measured by use of X-Rite 528 Spectrodensitometer (manufactured by X-Rite, Incorporated).

Figure 6:
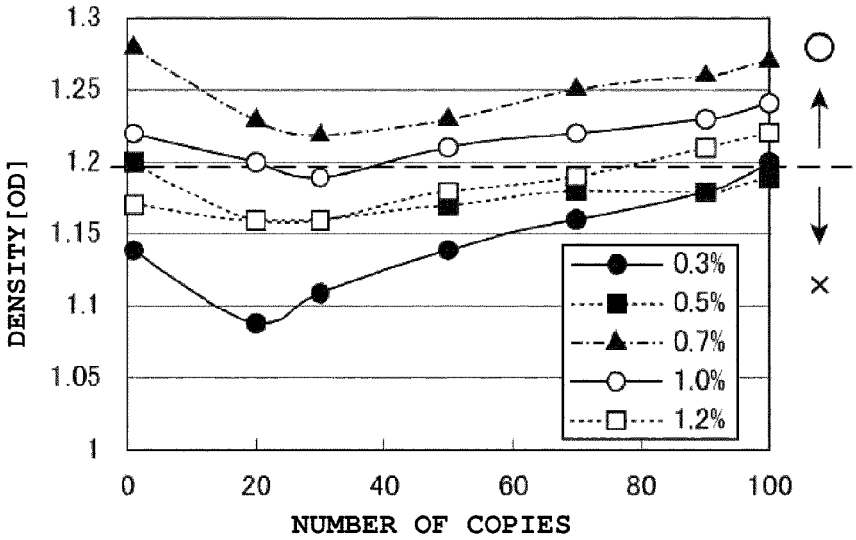
FIG. 6 is another diagram showing a relationship between an amount (% by weight) of external additive and a value representing density of a printed image.

Table 6 and FIG. 6 show the result of the measurement. Table 6 shows a relationship between each amount of added external additive (% by weight) and its corresponding density (OD) of the printed copies of the image. FIG. 6 graphically shows the relationship shown in Table 6. In this experiment, amounts of added external additive which do not make the density (OD) of the printed copies of the image lower than and equal to 1.2 (OD) are evaluated as desirable and marked with "G" (good), and are evaluated as poor and marked with "P" if mounts of added external additive which do not make the density (OD) of the printed copies of the image higher than 1.2 (OD).

By contrast, in a case where the difference in the amount of added external additive is too large, or in a case where the amount of adhering part of external additive contained in toner HT is smaller than the amount of adhering part of external additive contained in toner HQ, apparatus members are electrostatically charged defectively. Accordingly, the density of the printed copies of the image decreases. Subsequently, however, the density of the printed copies of the image resumes recovery because toner HQ is supplied gradually.

The experiment gives a result that the density of the printed copies is desirable when the amount of external additive contained in toner HT is such that the difference between the amount of external additive added to toner HT and the amount of external additive added to toner HQ is −0.7% by weight. On the basis of this result, the inventors determine that the amount of external additive used for toner HT should be set in a way that the difference between the amount of external additive added to toner HT and the amount of external additive added to toner HQ is −0.6% by weight to −1.0% by weight (preferably, −0.7% by weight).

Even when initial copies of images start to be printed, as described above, Example 2 makes it possible to print the initial copies thereof with a sufficient density by containing 2.9% by weight to 3.6% by weight (preferably, 2.9% by weight to 3.3% by weight) of external additive in toner HQ, and 2.2% by weight to 3.0% by weight (preferably, 2.2% by weight to 2.7% by weight; and more preferably, 2.5% by weight to 2.6% by weight) of external additive in toner HT.

As described above, if toners each with an excessively high glass transition temperature are used with too much emphasis being put on the long-term storage stability of the toners contained in each image forming unit, the fixing properties of the toner decrease.

TABLE 6

| | Number of copies | | | | | | |
|---|---|---|---|---|---|---|---|
| | 1 | 20 | 30 | 50 | 70 | 90 | 100 |
| Difference in amount of external additive 0.3 [%] | P 1.44 | P 1.09 | P 1.11 | P 1.14 | P 1.16 | P 1.18 | G 1.2 |
| Difference in amount of external additive 0.5 [%] | G 1.2 | P 1.16 | P 1.16 | P 1.17 | P 1.18 | P 1.18 | P 1.19 |
| Difference in amount of external additive 0.7 [%] | G 1.28 | G 1.23 | G 1.22 | G 1.23 | G 1.25 | G 1.26 | G 1.27 |
| Difference in amount of external additive 1.0 [%] | G 1.22 | G 1.2 | P 1.19 | G 1.21 | G 1.22 | G 1.23 | G 1.24 |
| Difference in amount of external additive 1.2 [%] | P 1.17 | P 1.16 | P 1.16 | P 1.18 | P 1.19 | G 1.21 | G 1.22 |

In a case where the difference in the amount of added external additive is smaller, or in a case where the amount of adhering part of external additive contained in toner HT is closer to the amount of adhering part of external additive contained in toner HQ, the amount of external additive contained in toner HT is so large that the base particles of toner HT are less capable of holding the external additives. As a result, part of the external additive is separated from toner HT. The separated part of the external additive adheres to development roller 32, supplying roller 33 and the like. Thus, the density of the printed copies of the image decreases. However, after a certain number of copies are printed (for example, after approximately 20 copies are printed when the difference in the amount of added external additive is −0.3% by weight), the adhering part of the external additive is removed from the development roller 32 and supplying roller 33 due to their frictional sliding. Thus, the density of printed copies of the image resumes recovery.

The image forming units and image forming apparatus according to the invention are capable of preventing occurrence of adhering matters and clumped materials, and concurrently of securing the desirable fixing properties to the toners even when initial images are formed.

Note that the invention can be applied to copying machines, facsimile machines, MFPs (Multifunctional Peripheries) and the like although the embodiment is described by giving the example of the printer.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

What is claimed is:

1. An image forming unit comprising:

a developer container configured to contain a developer; and a developer supplier including at least a developer carrier configured to supply the developer, contained in the developer container, to a latent image formed on an image carrier, wherein a glass transition temperature of a first developer initially contained in the developer supplier is higher than a glass transition temperature of a second developer contained in the developer container, and the glass transition temperature of the first developer is not higher than 75° C. and not lower than 64° C.

2. The unit of claim 1, wherein the glass transition temperature of the second developer is between 56° C. and 62° C. inclusive.

3. The unit of claim 1, wherein a color of the first developer is the same as a color of the second developer.

4. The unit of claim 1, wherein the second developer contains a larger amount of an external additive than the first developer.

5. The unit of claim 4, wherein the second developer contains the external additive in a range of 2.9% by weight to 3.6% by weight, inclusive, of a total weight of the second developer.

6. The unit of claim 4, wherein the first developer contains the external additive in a range of 2.2% by weight to 3.0% by weight, inclusive, of a total weight of the first developer.

7. An image forming apparatus comprising:

an image forming unit configured to form a developer image by supplying a developer to an electrostatic latent image formed on a surface of an image carrier;

a transferrer configured to transfer the developer image, formed by the image forming unit, onto a recording medium; and a fixing unit configured to fix the developer image transferred onto the recording medium, wherein the image forming unit comprises:

a developer container configured to contain the developer; and a developer supplier including at least a developer carrier configured to supply the developer, contained in the developer container, to the latent image formed on the image carrier, a glass transition temperature of a first developer initially contained in the developer supplier is higher than a glass transition temperature of a second developer contained in the developer container, and the glass transition temperature of the first developer is not higher than 75° C. and not lower than 64° C.

8. The image forming apparatus of claim 7, wherein the glass transition temperature of the second developer is between 56° C. and 62° C. inclusive.

9. The image forming apparatus of claim 7, wherein a color of the first developer is the same as a color of the second developer.

10. The image forming apparatus of claim 7, wherein the second developer contains a larger amount of external additive than the first developer.

11. The image forming apparatus of claim 10, wherein the second developer contains the external additive of an amount in a range of 2.9% by weight to 3.6% by weight, inclusive, of a total weight of the second developer.

12. The image forming apparatus of claim 10, wherein the first developer contains the external additive of an amount in a range of 2.2% by weight to 3.0% by weight, inclusive, of a total weight of the first developer.

* * * * *